US009033750B2

(12) United States Patent
Miller et al.

(10) Patent No.: US 9,033,750 B2
(45) Date of Patent: May 19, 2015

(54) ELECTRICAL CONTACT

(71) Applicant: Tyco Electronics Corporation, Berwyn, PA (US)

(72) Inventors: Keith Edwin Miller, Manheim, PA (US); Chong Hun Yi, Mechanicsburg, PA (US); Matthew Richard McAlonis, Elizabethtown, PA (US); Kevin Thackston, York, PA (US); Dustin Carson Belack, Hummelston, PA (US); Albert Tsang, Harrisburg, PA (US); Nicholas Paul Ruffini, York, PA (US); Darryl J. McKenney, Londonderry, NH (US); Erica L. Ouellette, Dedham, MA (US)

(73) Assignees: TYCO ELECTRONICS CORPORATION, Berwyn, PA (US); MERCURY SYSTEMS, INC., Chelmsford, MA (US)

( * ) Notice: Subject to any disclaimer, the term of this patent is extended or adjusted under 35 U.S.C. 154(b) by 13 days.

(21) Appl. No.: 13/743,128

(22) Filed: Jan. 16, 2013

(65) Prior Publication Data

US 2014/0051294 A1 Feb. 20, 2014

Related U.S. Application Data

(60) Provisional application No. 61/683,537, filed on Aug. 15, 2012.

(51) Int. Cl.
*H01R 4/48* (2006.01)
*H01R 13/26* (2006.01)

(Continued)

(52) U.S. Cl.
CPC ..... *H01R 13/26* (2013.01); *H01R 12/714* (2013.01); *H01R 13/2492* (2013.01)

(58) Field of Classification Search
CPC ..... H01R 13/2442
USPC ..... 439/862, 637, 630, 733.1
See application file for complete search history.

(56) References Cited

U.S. PATENT DOCUMENTS 2,917,612 A 12/1959 Chabot et al.
3,040,291 A 6/1962 Schweitzer et al.

(Continued)

FOREIGN PATENT DOCUMENTS

EP 0 390 070 A2 10/1990
EP 1256145 11/2002

(Continued)

OTHER PUBLICATIONS

International Search Report, International Application No. PCT/US2013/053732, International Filing Date, Aug. 6, 2013.

*Primary Examiner* — Phuong Dinh

(57) ABSTRACT

An electrical contact is provided for mating with a mating contact. The electrical contact includes a base extending a length along a central longitudinal axis, and an arm extending a length outward from the base along the central longitudinal of the base. The arm includes a first mating bump and a second mating bump. The first and second mating bumps have respective first and second mating surfaces. The arm is configured to engage the mating contact at each of the first and second mating surfaces to establish an electrical connection with the mating contact. The first mating surface of the first mating bump is spaced apart along the length of the arm from the second mating surface of the second mating bump.

16 Claims, 6 Drawing Sheets

(51) Int. Cl.
*H01R 13/24* (2006.01)
*H01R 12/71* (2011.01)

(56) References Cited

U.S. PATENT DOCUMENTS

| | | | | |
|---|---|---|---|---|
| 3,262,082 | A | 7/1966 | Gammel, Sr. | |
| 3,283,291 | A | 11/1966 | Krol et al. | |
| 3,470,522 | A | 9/1969 | Lawrence et al. | |
| 3,509,520 | A | 4/1970 | Cobban et al. | |
| 3,601,774 | A | 8/1971 | Stathos | |
| 3,609,633 | A | 9/1971 | Hargett | |
| 4,002,400 | A * | 1/1977 | Evans | 439/748 |
| 4,541,684 | A | 9/1985 | Holman et al. | |
| 5,080,613 | A * | 1/1992 | Orui et al. | 439/660 |
| 5,154,621 | A | 10/1992 | Legrady | |
| 5,478,261 | A | 12/1995 | Bogese, II | |
| 5,795,191 | A | 8/1998 | Preputnick et al. | |
| 6,009,606 | A * | 1/2000 | Voigtlaender et al. | 28/248 |
| 6,024,581 | A | 2/2000 | Barnett et al. | |
| 6,079,988 | A | 6/2000 | Hashiguchi et al. | |
| 6,152,790 | A | 11/2000 | Morris | |
| 6,261,107 | B1 | 7/2001 | Takase et al. | |
| 6,315,621 | B1 | 11/2001 | Natori et al. | |
| 6,482,041 | B1 | 11/2002 | Yu-Feng | |
| 6,527,590 | B2 | 3/2003 | Oguchi | |
| 6,565,387 | B2 | 5/2003 | Cohen | |
| 6,645,012 | B2 * | 11/2003 | Ito et al. | 439/637 |
| 6,685,512 | B2 | 2/2004 | Ooya | |
| 6,764,345 | B1 | 7/2004 | Duesterhoeft et al. | |
| 6,932,649 | B1 | 8/2005 | Rothermel et al. | |
| 7,021,957 | B2 | 4/2006 | Sweetland et al. | |
| 7,322,856 | B2 | 1/2008 | Laurx et al. | |
| 7,794,235 | B2 | 9/2010 | Wallace | |
| 8,113,887 | B2 * | 2/2012 | Osawa et al. | 439/637 |
| 8,469,720 | B2 | 6/2013 | Gulla | |
| 8,550,861 | B2 | 10/2013 | Cohen et al. | |
| 8,727,791 | B2 | 5/2014 | Gulla | |
| 2002/0098740 | A1 | 7/2002 | Ooya | |
| 2010/0323564 | A1 | 12/2010 | Clark et al. | |
| 2011/0067237 | A1 | 3/2011 | Cohen et al. | |
| 2014/0065883 | A1 | 3/2014 | Cohen et al. | |
| 2014/0308852 | A1 | 10/2014 | Gulla | |
| 2014/0322985 | A1 | 10/2014 | Gulla | |

FOREIGN PATENT DOCUMENTS

| | | | |
|---|---|---|---|
| EP | 1427061 | | 6/2004 |
| EP | 1531653 | | 5/2005 |
| EP | 1 973 202 | A1 | 9/2008 |
| JP | 5154784 | A | 6/1993 |
| WO | 2011031311 | A2 | 7/2011 |

* cited by examiner

ELECTRICAL CONTACT

CROSS-REFERENCE TO RELATED APPLICATIONS

This application is a non-provisional application that claims priority to and the benefit of the filing date of U.S. Provisional Application No. 61/683,537, filed on Aug. 15, 2012, and entitled "ELECTRICAL CONTACT," which is hereby incorporated by reference herein.

BACKGROUND OF THE INVENTION

The subject matter described and/or illustrated herein relates generally to electrical contacts.

Some known electrical connector assemblies are exposed to vibrations during use. For example, electrical connector assemblies that are used within relatively rugged environments may experience vibrational forces during use. Such vibrations may cause wear to the electrical contacts of one or both of the complementary electrical connectors of the assembly that mate together. Such wear may decrease the quality of the electrical connection between the complementary electrical connectors, may completely interrupt electrical connection between one or more mated pairs of electrical contacts of the complementary electrical connectors, may increase a maintenance and/or replacement cost of the electrical connector assembly, and/or the like.

One example of wear caused by vibrations includes an electrical connector having an electrical contact that includes an arm that engages an electrical contact pad of a circuit board of the complementary electrical connector. When the electrical connectors are mated together such that the arm is engaged with the contact pad, vibrational forces may cause the arm to vibrate relative to the contact pad. Relative vibration between the arm and the contact pad may cause wear to the contact pad and/or the arm. Such wear may include surface pitting, surface material loss, wearing at least partially through an electrically conductive surface coating (e.g., a plating), and/or the like. Wear caused to a surface coating of an electrical contact is commonly referred to as "contact fretting".

BRIEF DESCRIPTION OF THE INVENTION

In one embodiment, an electrical contact is provided for mating with a mating contact. The electrical contact includes a base extending a length along a central longitudinal axis, and an arm extending a length outward from the base along the central longitudinal of the base. The arm includes a first mating bump and a second mating bump. The first and second mating bumps have respective first and second mating surfaces. The arm is configured to engage the mating contact at each of the first and second mating surfaces to establish an electrical connection with the mating contact. The first mating surface of the first mating bump is spaced apart along the length of the arm from the second mating surface of the second mating bump.

In another embodiment, an electrical contact is provided for mating with a mating contact. The electrical contact includes a base extending a length along a central longitudinal axis, a first arm extending a length outwardly from the base along the central longitudinal axis of the base, and a second arm extending a length outward from the base. The first and second arms include respective first and second mating surfaces. The first and second arms are configured to engage the mating contact at the first and second mating surfaces. The first arm has a different response to vibration than the second arm.

In another embodiment, an electrical connector is provided for mating with a mating connector having a mating contact. The electrical connector includes a housing and an electrical contact held by the housing and configured to mate with the mating contact. The electrical contact includes a base extending a length along a central longitudinal axis, and an arm extending a length outward from the base along the central longitudinal of the base. The arm includes a first mating bump and a second mating bump. The first and second mating bumps have respective first and second mating surfaces. The arm is configured to engage the mating contact at each of the first and second mating surfaces to establish an electrical connection with the mating contact. The first mating surface of the first mating bump is spaced apart along the length of the arm from the second mating surface of the second mating bump.

DETAILED DESCRIPTION OF THE INVENTION

Figure 1:
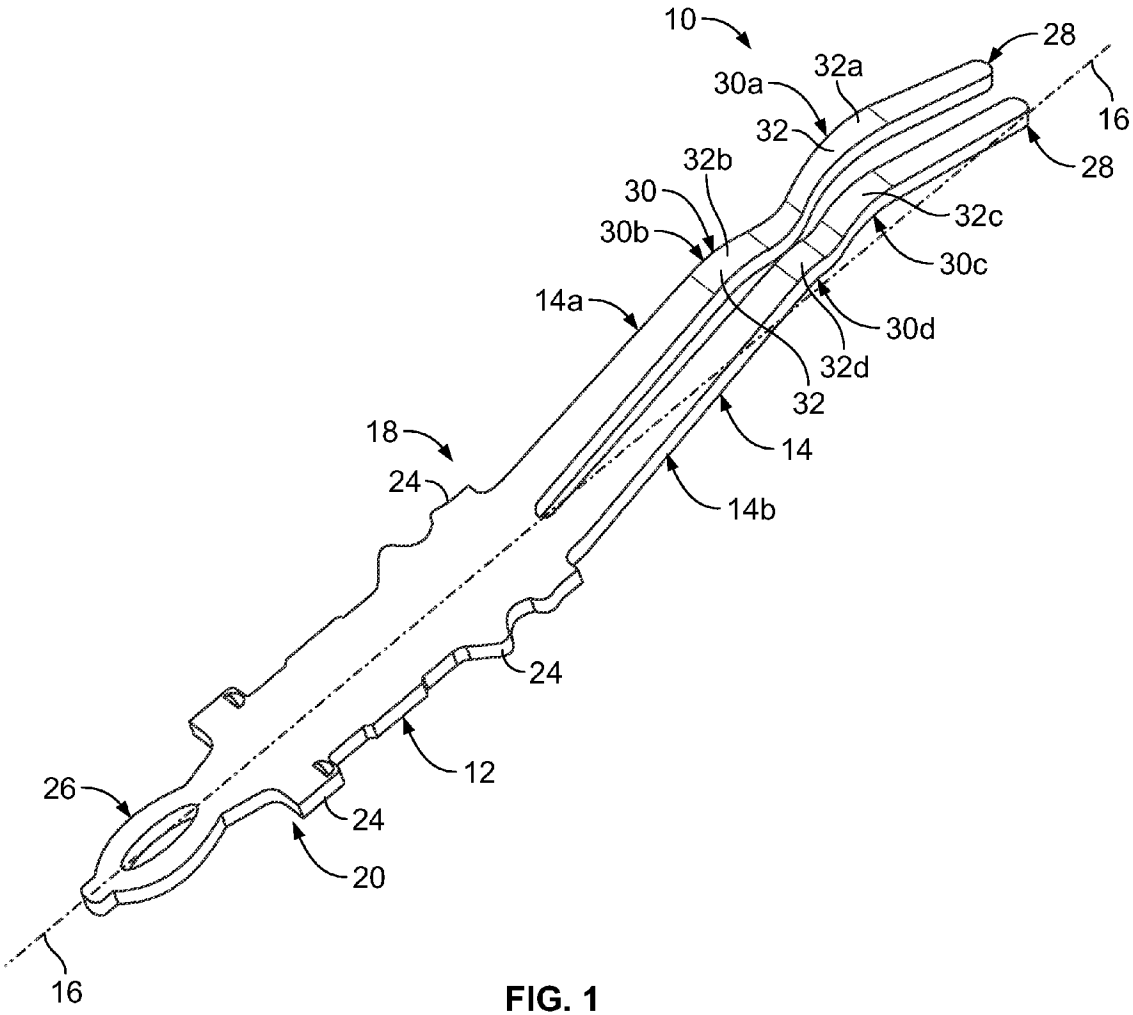
FIG. 1 is a perspective view of an exemplary embodiment of an electrical contact.

FIG. 1 is a perspective view of an exemplary embodiment of an electrical contact 10. The electrical contact 10 includes a base 12 and one or more arms 14 that extend from the base 12. The base 12 extends a length along a central longitudinal axis 16 of the base 12. In the exemplary embodiment, the base 12 extends the length from an arm end 18 of the base 12 to a mounting end 20 of the base 12. The arms 14 extend outwardly from the arm end 18 of the base 12. As will be described in more detail below, the arms 14 are configured to mate with a mating contact 22 (FIGS. 6-9) to establish an electrical connection between the electrical contact 10 and the mating contact 22.

Figure 9:
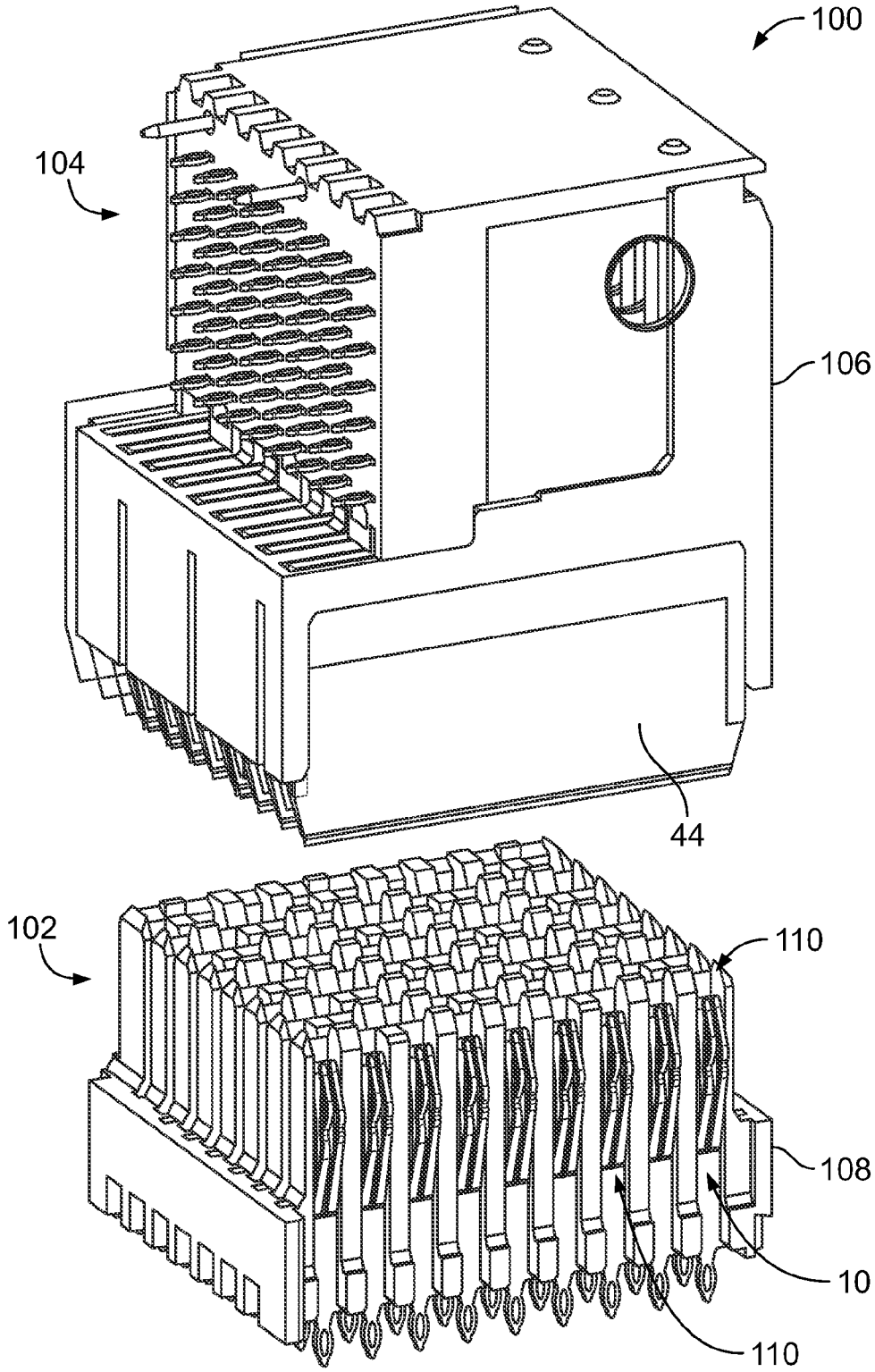
FIG. 9 is a partially exploded perspective view of an exemplary embodiment of an electrical connector assembly with which the electrical contact shown in FIGS. 1-8 may be used.

The base 12 may include one or more mounting structures for mounting the base 12 within a housing (e.g., the housing 108 shown in FIG. 9) of an electrical connector (e.g., the electrical connector 102 shown in FIG. 9). In the exemplary embodiment, the base 12 includes interference tabs 24 that are configured to engage the housing with an interference-fit to hold the base 12 within the housing. Other structures (e.g., snap-fit structures, latches, fasteners, and/or the like) may be used in addition or alternative to the interference tabs 24 to hold the base 12 within an electrical connector housing.

In the exemplary embodiment, the electrical contact 10 includes a mounting segment 26 that extends from the mounting end 20 of the base 12. The mounting segment 26 is configured to mount the electrical contact 10 to a circuit board (not shown). Alternatively, the electrical contact 10 is configured to terminate the end (not shown) of an electrical cable (not shown) at the mounting end 20 of the base 12 or is configured to mate with another mating contact (not shown) at the mounting end 20 of the base 12 (i.e., in addition to mating with the mating contact 22 at the arms 14). In the exemplary embodiment, the mounting segment 26 is an eye-of-the needle press-fit pin that is configured to be press fit into an electrical via (not shown) of the circuit board. But, the mounting segment 26 may additionally or alternatively include any other structure for mounting the electrical contact 10 to the circuit board, such as, but not limited to, solder tail, a surface mount pad (whether or not solder is used), another type of press-fit pin, and/or the like. Although the length of the base 12 is shown as being approximately straight, alternatively the length of the base 12 includes one or more bends, such as, but not limited to, an approximately 90° bend and/or the like). For example, in some embodiments, the base 12 includes an approximately 90° bend such that the electrical contact 10 is a right-angle contact designed for use within an orthogonal electrical connector.

The electrical contact 10 may include any number of the arms 14. In the exemplary embodiment, the electrical contact 10 has a fork-like structure that includes two of the arms 14, namely the arms 14*a* and 14*b*. Each of the arms 14*a* and 14*b* extends a length outwardly from the base 12 along the central longitudinal axis 16 of the base 12. In the exemplary embodiment, the arms 14 extend the lengths outwardly from the arm end 18 of the base 12 to free ends 28 of the arms 14, as can be seen in FIG. 1. Alternatively, the end 28 of one or more of the arms 14 is not free, but rather is connected to another structure, such as, but not limited to, the end 28 of another arm 14. The arms 14*a* and 14*b* may each be referred to herein as a "first" arm and/or a "second" arm.

Each of the arms 14*a* and 14*b* includes one or more mating bumps 30 at which the arm 14 mates with the mating contact 22. In the exemplary embodiment, the arm 14*a* includes two mating bumps 30*a* and 30*b*, and the arm 14*b* includes two mating bumps 30*c* and 30*d*. But, the arm 14*a* may include any number of the mating bumps 30 and the arm 14*b* may include any number of the mating bumps 30 (whether or not the number of mating bumps 30 of the arm 14*b* is the same as the number of mating bumps 30 of the arm 14*a*). Each of the mating bumps 30*a*, 30*b*, 30*c*, and 30*d* may be referred to herein as a "first" mating bump and/or a "second" mating bump.

Each mating bump 30 includes a mating surface 32. Specifically, the mating bumps 30*a*, 30*b*, 30*c*, and 30*d* include respective mating surfaces 32*a*, 32*b*, 32*c*, and 32*d*. Each mating bump 30 engages the mating contact 22 at the mating surface 32 thereof to establish an electrical connection with the mating contact 22. Each of the mating surfaces 32*a*, 32*b*, 32*c*, and 32*d* may be referred to herein as a "first" mating surface and/or a "second" mating surface. In the exemplary embodiment, the mating contact 22 is a contact pad of a circuit board 44 (FIGS. 6-9) and the mating bumps 30 and the mating surfaces 32 are configured to mate with the contact pad. Alternatively, the mating bumps 30 and the mating surfaces 32 are configured to mate with another type of mating contact, such as, but not limited to, a blade, a bar, an arm, a spring, and/or the like.

The electrical contact 10 may be fabricated from (i.e., include) any electrically conductive material, such as, but not limited to, copper, nickel, gold, silver, aluminum, tin, and/or the like. In some embodiments, at least a portion of the electrical contact 10 (e.g., the arms 14*a* and/or 14*b*, the base 12, the mounting segment 26, the mating bumps 30*a*, 30*b*, 30*c*, and/or 30*d*, portions thereof, and/or the like) includes a base material that is coated with an electrically conductive surface coating (e.g., a plating and/or the like). The electrically conductive surface coating may be fabricated from any electrically conductive material, such as, but not limited to, copper, nickel, gold, silver, aluminum, tin, and/or the like.

Figure 2:
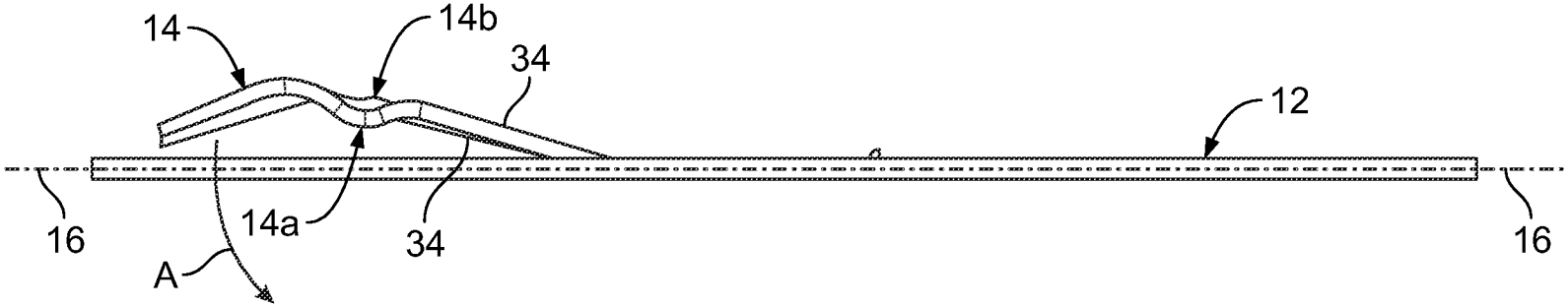
FIG. 2 is a side elevational view of the electrical contact shown in FIG. 1.

FIG. 2 is side elevational view of the electrical contact 10. As can be seen in FIG. 2, in the exemplary embodiment, the arms 14*a* and 14*b* each extend outwardly from the base 12 at a non-parallel angle relative to the central longitudinal axis 16 of the base 12. Specifically, a base segment 34 of each of the arms 14*a* and 14*b* extends outwardly from the base 12 at the non-parallel angle relative to the central longitudinal axis 16. In some alternative embodiments, the base segment 34 of the arm 14*a* and/or the arm 14*b* extends outwardly from the base 12 at an approximately parallel angle relative to the central longitudinal axis 16 of the base 12. The base segment 34 of each arm 14 may extend outwardly from the base 12 at any angle relative to the central longitudinal axis 16 of the base 12.

Figure 7:
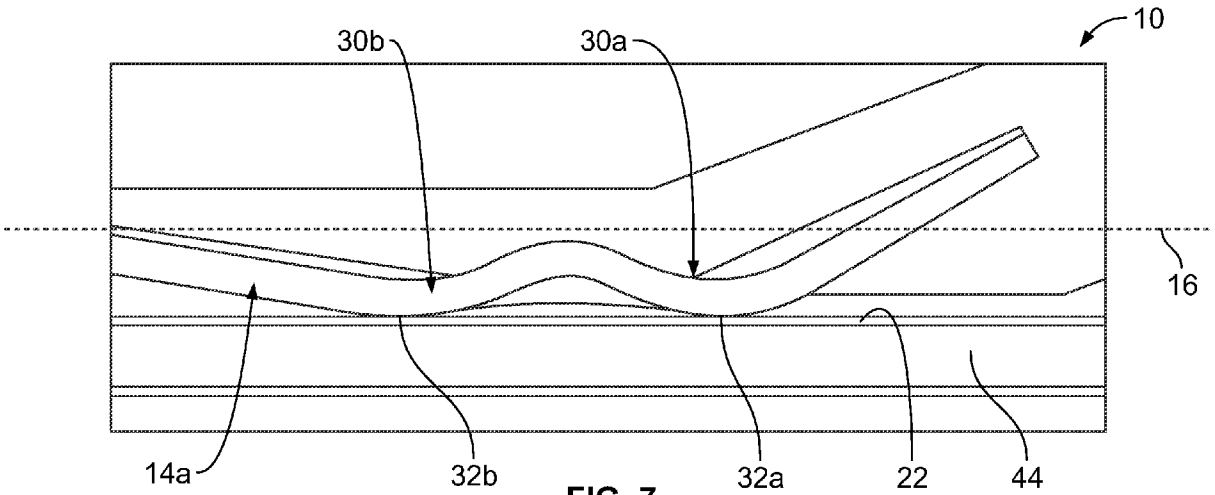
FIG. 7 is a side elevational view illustrating the arm shown in FIG. 3 mated with the exemplary mating contact.
Figure 8:
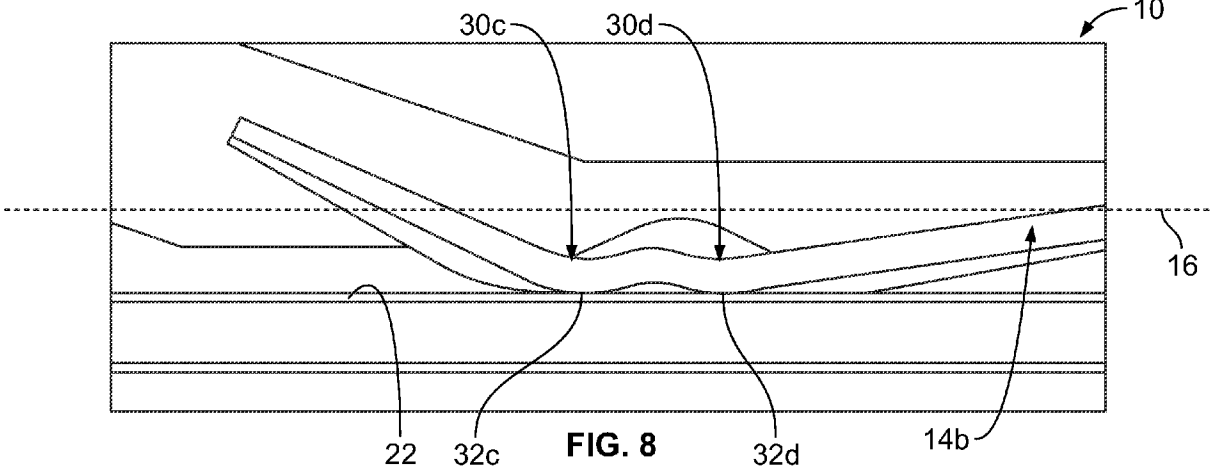
FIG. 8 is a side elevational view illustrating the arm shown in FIG. 5 mated with the exemplary mating contact.

Optionally, one or more of the arms 14 is a spring that is configured to be resiliently deflected from a resting position when the arm 14 is mated with the mating contact 22. In the exemplary embodiment, each of the arms 14*a* and 14*b* is a resiliently deflectable spring. The arms 14*a* and 14*b* are shown in the resting positions in FIG. 2. As the arms 14*a* and 14*b* engage the mating contact 22, the arms 14*a* and 14*b* are resiliently deflected along an arc A from the resting positions shown in FIG. 2 to deflected positions, which are shown in FIGS. 7 and 8, respectively. Each arm 14 may deflect by any amount along the arc A.

Figure 3:
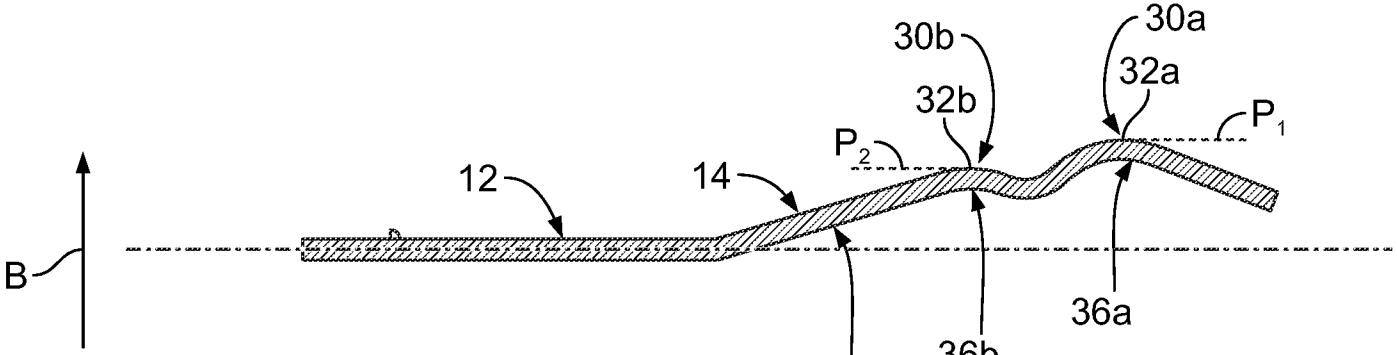
FIG. 3 is a cross-sectional view of the electrical contact shown in FIGS. 1 and 2 illustrating an exemplary embodiment of an arm of the electrical contact.

FIG. 3 is a cross-sectional view of the electrical contact 10 illustrating the arm 14*a*. The arm 14*a* is shown in the resting position in FIG. 3. Referring now to FIGS. 1 and 3, the arm 14*a* includes the mating bumps 30*a* and 30*b*, which include the respective mating surfaces 32*a* and 32*b*. The mating surface 32*a* of the mating bump 30*a* is spaced apart along the length of the arm 14*a* from the mating surface 32*b* of the mating bump 30*a*. In other words, the mating surface 32*a* of the mating bump 30*a* is staggered along the length of the arm 14*a* relative to the mating surface 32*b* of the mating bump 30*b* such that the mating surfaces 32*a* and 32*b* have different axial locations along the central longitudinal axis 16 of the base 12. The mating surfaces 32*a* and 32*b* may be spaced apart along the length of the arm 14*a* by any amount.

Referring now solely to FIG. 3, optionally, the mating surfaces 32*a* and 32*b* of the respective mating bumps 30*a* and 30*b* are offset from the central longitudinal axis 16 of the base 12 in the direction of the arrow B when the arm 14*a* is in the resting position. The mating surfaces 32*a* and 32*b* are optionally offset from the central longitudinal axis 16 of the base 12 in the direction of the arrow B by different amounts when the arm 14*a* is in the resting position, as is shown in the exemplary embodiment. In other words, when the arm 14*a* is in the resting position, the mating surfaces 32*a* and 32*b* extend within respective planes $P_1$ and $P_2$ that extend approximately parallel to the central longitudinal axis 16, wherein the planes $P_1$ and $P_2$ are offset from the central longitudinal axis 16 in the direction of the arrow B by different amounts. Each of the mating surfaces 32*a* and 32*b* may be offset from the central longitudinal axis 16 in the direction of the arrow B by any amount when the arm 14*a* is in the resting position. Moreover, the difference between the offsets of the mating surfaces 32*a* and 32*b* from the central longitudinal axis 16 in the direction of the arrow B when the arm 14*a* is in the resting position may be any amount.

As can be seen in FIG. 3, in the exemplary embodiment, each of the mating bumps 30*a* and 30*b* of the arm 14*a* is defined by a respective bend 36*a* and 36*b* in the arm 14*a*. But, the mating bumps 30*a* and 30*b* are not limited to being defined by a bend of the arm 14*a*. Rather, in alternative to being defined by a bend, each of the mating bumps 30*a* and 30*b* may be defined by another structure, such as, but not limited to, a segment of increased thickness and/or the like.

Figure 4:
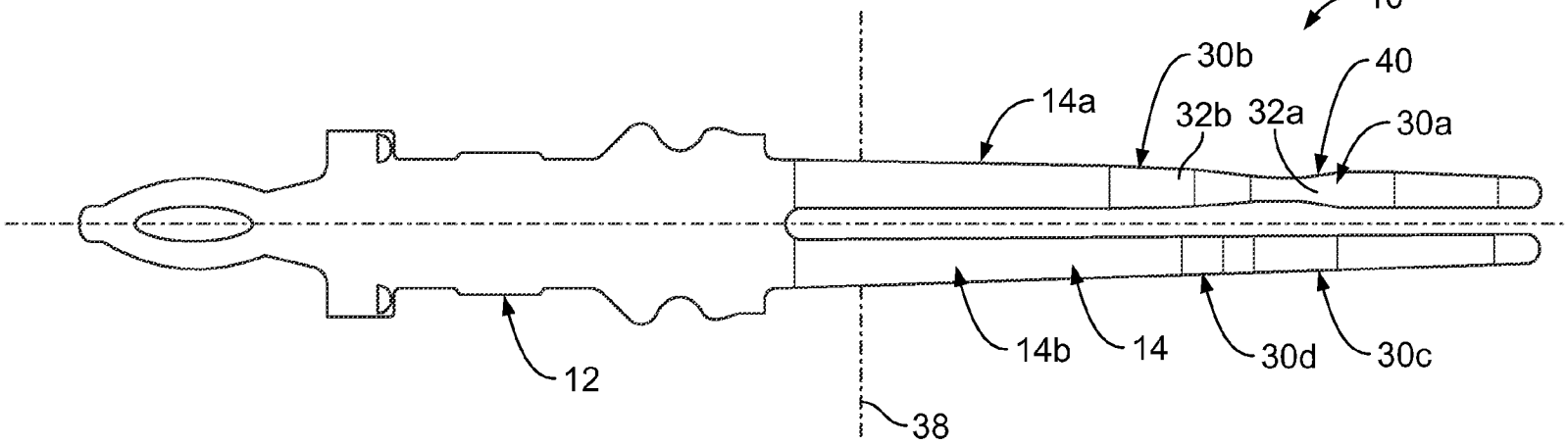
FIG. 4 is a plan view of the electrical contact shown in FIGS. 1-3.

FIG. 4 is a plan view of the electrical contact 10. The arm 14*a* extends a width along a width axis 38 that extends approximately perpendicular to the central longitudinal axis 16 of the base 12. Optionally, the arm 14*a* includes a necked-down segment 40 wherein the width of the arm 14*a* is reduced as compared to adjacent axial locations along the length of the arm 14*a*. The necked-down segment optionally extends at approximately the same axial location along the length of the arm 14*a* (i.e., along the central longitudinal axis 16) as the mating bump 30*a*, as is shown in the exemplary embodiment. In some alternative embodiments, the necked-down segment 40 extends at approximately the same axial location along the length of the arm 14*a* as the mating bump 30*b* instead of as the mating bump 30*a*. Moreover, in some alternative embodiments, the arm 14*a* includes a necked-down segment 40 at both of the mating bumps 30*a* and 30*b*. The arm 14*a* may include any number of necked down segments 40, each of which may have any axial location along the length of the arm 14*a* and may have a width that is reduced by any amount. Although not shown, in some embodiments, the arm 14*b* includes one or more necked-down segments (not shown) wherein the width of the arm 14*b* is reduced as compared to adjacent axial locations along the length of the arm 14*b*. In some embodiments, a necked down segment of the arm 14*b* extends at a different axial location along the central longitudinal axis 16 than one or more of the necked down segments 40 of the arm 14*a*, and/or vice versa. In the exemplary embodiment, the arms 14*a* and 14*b* have the same length as each other, as is shown in FIG. 4. But, the arms 14*a* and 14*b* may have different lengths than each other. In embodiments wherein the arms 14*a* and 14*b* have different lengths, the arm 14*a* may be longer than the arm 14*b*, or vice versa.

Referring now to FIGS. 1, 3, and 4, the positions, orientations, dimensions, and/or the like of the arm 14*a* and the various components of the arm 14*a* (e.g., the base segment 34, the necked-down segment(s) 40, the mating bumps 30*a* and 30*b*, the mating surfaces 32*a* and 32*b*, and/or the like) provide the arm 14*a* with a predetermined geometry. In other words, the arm 14*a* includes the predetermined geometry. The predetermined geometry of the arm 14*a* provides the arm 14*a* with a predetermined response to vibration. In other words, the predetermined geometry of the arm 14*a* provides the arm 14*a* with a predetermined response to vibrational forces experienced by the arm 14*a*. For example, the predetermined geometry of the arm 14*a* provides the arm 14*a* with a predetermined natural (i.e., resonant) frequency and/or a predetermined response to forced vibration. The terms "response to vibration" and "vibrational response" are used interchangeably herein. The vibrational response of the arm 14*a* may be referred to herein as a "first" vibrational response and/or a "second" vibrational response.

Figure 5:
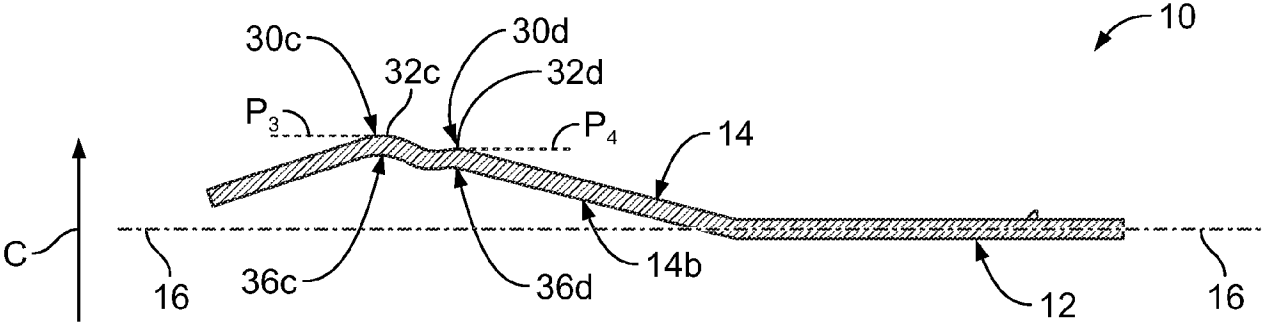
FIG. 5 is a cross-sectional view of the electrical contact shown in FIGS. 1-4 illustrating an exemplary embodiment of another arm of the electrical contact.

FIG. 5 is a cross-sectional view of the electrical contact 10 illustrating the arm 14*b*. The arm 14*b* is shown in the resting position in FIG. 5. Referring now to FIGS. 1 and 5, the arm 14*b* includes the mating bumps 30*c* and 30*d*, which include the respective mating surfaces 32*c* and 32*d*. The mating surface 32*c* of the mating bump 30*c* is spaced apart along the length of the arm 14*b* from the mating surface 32*d* of the mating bump 30*d*. In other words, the mating surface 32*c* of the mating bump 30*c* is staggered along the length of the arm 14*b* relative to the mating surface 32*d* of the mating bump 30*d* such that the mating surfaces 32*c* and 32*d* have different axial locations along the central longitudinal axis 16 of the base 12. The mating surfaces 32*c* and 32*d* may be spaced apart along the length of the arm 14*b* by any amount.

Referring now solely to FIG. 5, optionally, the mating surfaces 32*c* and 32*d* of the respective mating bumps 30*c* and 30*d* are offset from the central longitudinal axis 16 of the base 12 in the direction of the arrow C when the arm 14*b* is in the resting position. As shown in the exemplary embodiment, the mating surfaces 32*c* and 32*d* are optionally offset from the central longitudinal axis 16 of the base 12 in the direction of the arrow C by different amounts when the arm 14*b* is in the resting position. In other words, when the arm 14*b* is in the resting position, the mating surfaces 32*c* and 32*d* extend within respective planes $P_3$ and $P_4$ that extend approximately parallel to the central longitudinal axis 16, wherein the planes $P_3$ and $P_4$ are offset from the central longitudinal axis 16 in the direction of the arrow C by different amounts. Each of the mating surfaces 32*c* and 32*d* may be offset from the central longitudinal axis 16 in the direction of the arrow C by any amount when the arm 14*a* is in the resting position. Moreover, the difference between the offsets of the mating surfaces 32*c* and 32*d* from the central longitudinal axis 16 in the direction of the arrow C when the arm 14*b* is in the resting position may be any amount.

In the exemplary embodiment, each of the mating bumps 30*c* and 30*d* of the arm 14*b* is defined by a respective bend 36*c* and 36*d* in the arm 14*b*. But, the mating bumps 30*c* and 30*d* are not limited to being defined by a bend of the arm 14*b*. Rather, in alternative to being defined by a bend, each of the mating bumps 30*c* and 30*d* may be defined by another structure, such as, but not limited to, a segment of increased thickness and/or the like.

Referring now to FIGS. 1, 4, and 5, the positions, orientations, dimensions, and/or the like of the arm 14*b* and the various components of the arm 14*b* (e.g., the base segment 34, any necked-down segments, the mating bumps 30*c* and 30*d*, the mating surfaces 32*c* and 32*d*, and/or the like) provide the arm 14*b* with a predetermined geometry. In other words, the arm 14*b* includes the predetermined geometry. The predetermined geometry of the arm 14*b* provides the arm 14*b* with a predetermined response to vibration. In other words, the predetermined geometry of the arm 14*b* provides the arm 14*b* with a predetermined response to vibrational forces experienced by the arm 14*b*. For example, the predetermined geometry of the arm 14*b* provides the arm 14*b* with a predetermined natural (i.e., resonant) frequency and/or a predetermined response to forced vibration. The vibrational response of the arm 14*b* may be referred to herein as a "first" vibrational response and/or a "second" vibrational response.

Referring now solely to FIG. 4, the mating bump 30*c* and/or the mating bump 30*d* of the arm 14*b* may have a different axial location along the central longitudinal axis 16 of the base 12 than the both of the mating bumps 30*a* and 30*b* of the arm 14*a*, and/or vice versa. For example, in the exemplary embodiment, each of the mating bumps 30*c* and 30*d* of the arm 14*b* has a different axial location along the central longitudinal axis 16 of the base 12 than the both of the mating bumps 30*a* and 30*b* of the arm 14*a*. In the exemplary embodiment, the mating bumps 30*a* and 30*b* of the arm 14*a* are spaced further apart from each other along the central longitudinal axis 16 than the mating bumps 30*c* and 30*d* are spaced apart from each other along the central longitudinal axis 16. Alternatively, the mating bumps 30*c* and 30*d* of the arm 14*b* are spaced further apart from each other along the central longitudinal axis 16 than the mating bumps 30*a* and 30*b* are spaced apart from each other along the central longitudinal axis 16. In another alternative embodiment, the mating bumps 30*a* and 30*b* of the arm 14*a* are spaced apart from each other along the central longitudinal axis 16 by approximately the same amount as the mating bumps 30*c* and 30*d* are spaced apart from each other along the central longitudinal axis 16.

The different axial locations of the mating bumps 30 and the spacing between the mating bumps 30 is selected to provide the arms 14*a* and 14*b* with different predetermined geometries. In addition or alternative to the different spacings and/or axial locations, the positions, orientations, dimensions (e.g., the lengths, widths, and/or the like), and/or the like of the arms 14*a* and/or 14*b* and/or other various components of the arms 14*a* and/or 14*b* (e.g., the base segment 34, any necked-down segments, and/or the like) may provide the arms 14*a* and 14*b* with the different predetermined geometries.

The different predetermined geometries of the arms 14*a* and 14*b* provide the arms 14*a* and 14*b* with different predetermined vibrational responses than each other. In other words, the arms 14*a* and 14*b* will vibrate differently (e.g., at different frequencies and/or the like) than each other in response to the same vibrational force exerted on the arms 14*a* and 14*b*. For example, the arms 14*a* and 14*b* may have different natural frequencies and/or the arms 14*a* and 14*b* may vibrate differently in response to the same forced vibration exerted on the arms 14*a* and 14*b*. It should be understood that in embodiments wherein the electrical contact 10 includes more than two of the arms 14, each arm 14 may be provided with a different vibrational response than each other or at least one of the arms 14 may have the same vibrational response as at least one other arm 14.

Figure 6:
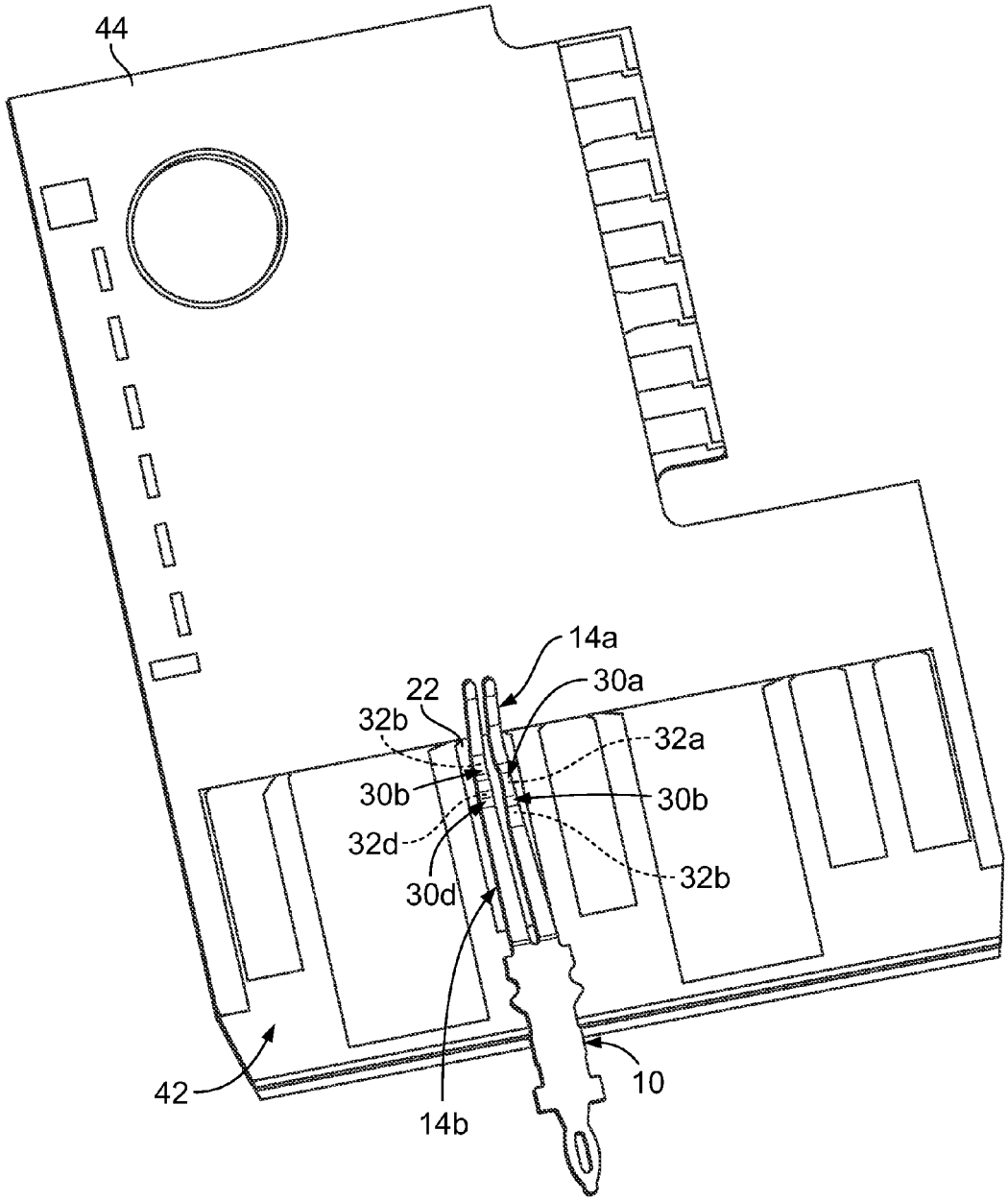
FIG. 6 is a plan view illustrating the electrical contact shown in FIGS. 1-5 mated with an exemplary mating contact.

FIG. 6 is a plan view illustrating the electrical contact 10 mated with the mating contact 22. In the exemplary embodiment, the mating contact 22 is a contact pad that extends on a side 42 of the circuit board 44. In the exemplary embodiment, both of the arms 14*a* and 14*b* of the electrical contact 10 mate with the same mating contact 22. Alternatively, the arms 14*a* and 14*b* mate with different mating contacts.

The arms 14*a* and 14*b* are engaged with the mating contact 22. Specifically, the mating surfaces 32*a*, 32*b*, 32*c*, and 32*d* of the mating bumps 30*a*, 30*b*, 30*c*, and 30*d*, respectively, are each engaged with the mating contact 22. The engagement between the arms 14*a* and 14*b* and the mating contact 22 establishes an electrical connection between the electrical contact 10 and the mating contact 22. As can be seen in FIG. 6, each arm 14*a* and 14*b* includes two separate points of engagement with the mating contact 22. Specifically, the arm 14*a* include the mating surfaces 32*a* and 32*b*, while the arm 14*b* includes the mating surfaces 32*c* and 32*d*. The electrical contact 10 thus has four separate points of engagement with the mating contact 22 in the exemplary embodiment. It should be understood that each arm 14*a* and 14*b* may include any number of separate points of engagement with the mating contact 22, and that the electrical contact 10 may have any overall number of separate points of engagement with the mating contact 22. For example, in some embodiments, one or more of the arms 14 has three or more separate points of engagement with the mating contact 22.

The different axial locations of the mating bumps 30*a* and 30*b* of the arm 14*a* along the central longitudinal axis 16 may cause the mating bumps 30*a* and 30*b* to have different predetermined vibrational responses than each other. In other words, the mating bumps 30*a* and 30*b* may vibrate differently (e.g., at different frequencies and/or the like) than each other at the different corresponding points of engagement with the mating contact 22. For example, the mating bumps 30*a* and 30*b* may have different natural frequencies and/or may vibrate differently in response to a forced vibration exerted on the arm 14*a*. Similarly, the different axial locations of the mating bumps 30*c* and 30*d* of the arm 14*b* along the central longitudinal axis 16 may cause the mating bumps 30*c* and 30*d* to vibrate differently (e.g., at different frequencies and/or the like) than each other at the different corresponding points of engagement with the mating contact 22. For example, the mating bumps 30*c* and 30*d* may have different natural frequencies and/or may vibrate differently in response to a forced vibration exerted on the arm 14*b*. It should be understood that in embodiments wherein the arm 14*a* and/or the arm 14*b* includes more than two of the mating bumps 30, each mating bump 30 of each arm 14 may be provided with a different vibrational response than each other mating bump 30 of the same arm or at least one of the mating bumps 30 of an arm 14 may have the same vibrational response as at least one other mating bump 30 of the same arm 14.

FIG. 7 is a side elevational view illustrating the arm 14*a* of the electrical contact 10 mated with the mating contact 22. FIG. 7 illustrates the arm 14*a* in the deflected position. The mating surfaces 32*a* and 32*b* of the respective mating bumps 30*a* and 30*b* are engaged with the mating contact 22. The arm 14*a* has been deflected from the resting position shown in FIGS. 1-4 to the deflected position shown in FIGS. 6 and 7. The mating surfaces 32*a* and 32*b* lie within a plane that extends approximately parallel to the central longitudinal axis 16. In other words, the mating surfaces 32*a* and 32*b* are offset from the central longitudinal axis 16 by approximately the same amount, which may be zero (i.e., no offset) or may be an offset of any amount.

FIG. 8 is a side elevational view illustrating the arm 14*b* of the electrical contact 10 mated with the mating contact 22. The arm 14*b* is shown in the deflected position in FIG. 8. The mating surfaces 32*c* and 32*d* of the respective mating bumps 30*c* and 30*d* are engaged with the mating contact 22. The arm 14*b* has been deflected from the resting position shown in FIGS. 1, 2, 4, and 5 to the deflected position shown in FIGS. 6 and 8. The mating surfaces 32*c* and 32*d* lie within a plane that extends approximately parallel to the central longitudinal axis 16. In other words, the mating surfaces 32*c* and 32*d* are offset from the central longitudinal axis 16 by approximately the same amount, which may be zero (i.e., no offset) or may be an offset of any amount.

Referring again to FIG. 6, by providing at least two separate points of engagement with the mating contact 22 at each arm 14 (i.e., the mating surfaces 32*a* and 32*b* of the arm 14*a* and the mating surfaces 32*c* and 32*d* of the arm 14*b*), each arm 14, and thus the electrical contact 10, may be less likely to be electrically disconnected from the mating contact 22 because of wear to the mating contact 22 and/or wear to the electrical contact 10. For example, because the two mating surfaces 32 of the same arm 14 are spaced apart from each other, the two mating surfaces 32 may not cause wear to the mating contact 22 and/or to the electrical contact 10 at the same rate as each other. Accordingly, if a first of the mating surfaces 32 of an arm 14 has worn the mating contact 22 such that the arm 14 no longer makes an adequate or any electrical connection with the mating contact 22 at the first mating surface 32, the second mating surface 32 of the arm 14 may have caused less or no wear to the mating contact 22 such that the arm 14 is adequately electrically connected to the mating contact 22 at the second mating surface. The difference in the wear rates caused by the two mating surfaces 32 of the same arm 14 may be a result, for example, of the different predetermined vibrational responses of the two mating bumps 30 of the same arm 14.

The redundant electrical connection provided by the two mating surfaces of an arm 14 may facilitate preventing or reducing data loss caused by wear to the electrical contact 10 and/or the mating contact 22, such as, but not limited to, wear caused by contact fretting and/or the like. For example, the redundant electrical connection provided by the two arms 14 may facilitate preventing or reducing data transmission errors. The electrical contact 10 may thus be adapted for relatively high speed data connections, such as, but not limited to, data speeds of at least approximately 5 gigabaud (G-baud).

In addition or alternative to providing two or more different wear rates, providing the at least two separate points of engagement with the mating contact 22 may reduce the force exerted on the mating contact 22 by the arm 14 at any single point of engagement with the mating contact 22. In other words, the force exerted on the mating contact 22 at each of the mating surfaces 32 of the same arm 14 may be less than if the arm 14 only engaged the mating contact 22 at a single point. Such a reduction in the force exerted on the mating contact 22 at any single point of engagement may reduce the amount of wear at such a single point of engagement, which may facilitate preventing the arm 14 from being electrically disconnected from the mating contact 22 because of wear to the mating contact 22. In addition or alternatively, such a reduction in the force exerted on the mating contact 22 at any single point of engagement (and/or the different axial locations of the mating bumps 30) may reduce the insertion and/or extraction force required to mate the electrical contact 10 with the mating contact 22, which may eliminate or reduce damage to the electrical contact 10 and/or the mating contact 22 as the contacts 10 and 22 are mated together.

Moreover, providing two or more different wear rates may facilitate preventing a higher resistance connection between the electrical contact 10 and the mating contact 22 that is caused by wear to the electrical contact 10 and/or the mating contact 22. For example, providing two or more different wear rates may reduce the amount of wear to an electrically conductive surface coating (e.g., a plating and/or the like) that extends on the mating contact 22 and/or the arm 14. Reducing the amount of wear to the coating(s) may prevent the coating(s) from being worn through. If the coating(s) is worn through, engagement with a base material of the mating contact 22 and/or the electrical contact 10 may increase the resistance of the electrical connection between the mating contact 22 and/or the electrical contact 10 above a desired level. Accordingly, by reducing the amount of wear to an electrically conductive coating that extends on the mating contact 22 and/or the arm 14, the at least two separate points of engagement between the arm 14 and the mating contact 22 may prevent the connection between the electrical contact 10 and the mating contact 22 from having a higher resistance than is desired.

The different predetermined vibrational responses of the arms 14*a* and 14*b* may facilitate preventing the electrical contact 10 from being electrically disconnected from the mating contact 22 because of wear to the mating contact 22. For example, the different predetermined vibrational responses of the arms 14*a* and 14*b* may cause wear to the mating contact 22 at the different rates. Accordingly, even if a first of the arms 14 of the electrical contact 10 has worn the mating contact 22 such that the first arm 14 no longer makes adequate or any electrically connected to the mating contact 22, the second arm 14 may have caused less or no wear to the mating contact 22 such that the second arm 14, and thus the electrical contact 10, remains adequately electrically connected to the mating contact 22. The different predetermined vibrational responses of the arms 14*a* and 14*b* may thus enable one of the arms 14 to provide a backup that maintains the electrical connection with the mating contact 22 upon electrical failure or a reduced quality of electrical connection of the other arm 14. The redundant electrical connection provided by the two arms 14 may facilitate preventing or reducing data loss caused by wear to the electrical contact 10 and/or the mating contact 22, such as, but not limited to, wear caused by contact fretting and/or the like. For example, the redundant electrical connection provided by the two arms 14 may facilitate preventing or reducing data transmission errors. The electrical contact 10 may thus be adapted for relatively high speed data connections.

Although shown and described herein with respect to a contact pad of a circuit board, it should be understood that the electrical contact 10 may be used with mating contacts having other structures, such as, but not limited to, a blade, a bar, an arm, a spring, and/or the like. The embodiments of the electrical contact 10 shown and/or described herein may be used to facilitate preventing the electrical contact 10 from being electrically disconnected from such other mating contact structures because of wear to the mating contact in a substantially similar manner to that described and/or illustrated herein with respect to the mating contact 22. Moreover, in a substantially similar manner to that described and/or illustrated herein with respect to the mating contact 22, the embodiments of the electrical contact 10 shown and/or described herein may be used to facilitate preventing a higher resistance connection between the electrical contact 10 and such other mating contact structures caused by wear to the electrical contact 10 and/or the mating contact.

FIG. 9 is a partially exploded perspective view of an exemplary embodiment of an electrical connector assembly 100 with which the electrical contact 10 may be used. The electrical connector assembly 100 is meant as exemplary only. The electrical contact 10 is not limited to being used with the type of electrical connector assembly shown in FIG. 9. Rather, the electrical contact 10 may be used with electrical connector assemblies of other types and/or having other structures.

The electrical connector assembly 100 includes an electrical connector 102 and a mating connector 104. The connectors 102 and 104 are complementary such that the connectors 102 and 104 are configured to mate together to establish an electrical connection therebetween. In the exemplary embodiment, the electrical connectors 102 and 104 are configured to be mounted on circuit boards (not shown).

The mating connector 104 includes a housing 106 and a plurality of the circuit boards 44 held by the housing 106. The circuit boards 44 include a plurality of the mating contacts 22 (FIGS. 6-8). The electrical connector 102 includes a housing 108 having a plurality of contact cavities 110. The contact cavities 110 hold electrical contacts 10. The electrical contacts 10 are configured to mate with the mating contacts 22 to establish an electrical connection between the electrical connector 102 and the mating connector 104.

The embodiments described and/or illustrated herein may provide an electrical contact that is less likely to be electrically disconnected from a mating contact because of wear to the mating contact. The embodiments described and/or illustrated herein may provide an electrical contact that experiences less wear and/or causes less wear to a mating contact with which the electrical contact mates. For example, the embodiments described and/or illustrated herein may provide an electrical contact that reduces or eliminates wear caused by contact fretting. The embodiments described and/or illustrated herein may provide an electrical contact that prevents or reduces data loss caused by wear to the electrical contact and/or a mating contact with which the electrical contact mates. The embodiments described and/or illustrated herein may provide an electrical contact that provides a reliable and relatively high speed data connection in relatively rugged environments. The embodiments described and/or illustrated herein may provide an electrical contact having a reduced insertion and/or extraction force. The embodiments described and/or illustrated herein may provide an electrical contact that causes less or no damage to a mating contact and/or the electrical contact as the mating contact and electrical contact are mated together.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical contact for mating with a mating contact, the electrical contact comprising:

a base extending a length along a central longitudinal axis; and a first arm extending outwardly from the base along the central longitudinal axis of the base, a second arm extending outwardly from the base, each of the first and second arms comprising first and second mating surfaces, each of the first and second arms being configured to engage the mating contact at the first and second mating surfaces, wherein the first arm has a different response to vibration than the second arm, wherein each of the first and second arms comprise first and second mating bumps, the first and second mating bumps including the first and second mating surfaces, respectively, wherein the first and second mating bumps of the first arm have different axial locations along the central longitudinal axis of the base than the first and second mating bumps of the second arm.

2. The electrical contact of claim 1, wherein the first arm comprises a first geometry and the second arm comprises a second geometry that is different than the first geometry, the first geometry of the first arm providing the first arm with a first vibrational response, the second geometry of the second arm providing the second arm with a second vibrational response that is different than the first vibrational response.

3. The electrical contact of claim 1, wherein the first arm extends a width approximately perpendicular to the central longitudinal axis of the base, the first arm comprising a necked-down segment wherein the width of the first arm is reduced.

4. An electrical connector for mating with a mating connector having a mating contact, the electrical connector comprising:

a housing; and an electrical contact held by the housing and configured to mate with the mating contact, the electrical contact comprising:

a base extending a length along a central longitudinal axis; and first and second arms extending outwardly from the base along the central longitudinal of the base, each of the first and second arms comprising a first mating bump and a second mating bump, the first and second mating bumps having respective first and second mating surfaces, each of the first and second arms being configured to engage the mating contact at each of the first and second mating surfaces to establish an electrical connection with the mating contact, wherein the first mating surface of the first mating bump is spaced apart along the length of the arm from the second mating surface of the second mating bump, wherein the first and second mating bumps of the first arm have different axial locations along the central longitudinal axis of the base than the first and second mating bumps of the second arm.

5. The electrical connector of claim 4, wherein the first and second arms of the electrical contact extend a width approximately perpendicular to the central longitudinal axis of the base, each of the first and second arms comprising a necked-down segment wherein the width of each of the first and second arms is reduced.

6. The electrical connector of claim 4, wherein each of the first and second arms of the electrical contact is a spring that is configured to be resiliently deflected from a resting position when each of the first and second arms is mated with the mating contact, the first and second mating surfaces being offset from the central longitudinal axis of the base by different amounts when each of the first and second arms is in the resting position, the first and second mating surfaces being offset from the central longitudinal axis by approximately the same amount when each of the first and second arms is mated with the mating contact.

7. An electrical contact for mating with a mating contact, the electrical contact comprising:

a base extending a length along a central longitudinal axis;

a first arm having a single free end extending outwardly from the base along the central longitudinal of the base, the first arm comprising a first mating bump and a second mating bump, the first and second mating bumps having respective first and second mating surfaces, the first arm being configured to engage the mating contact at each of the first and second mating surfaces to establish an electrical connection with the mating contact, wherein the first mating surface of the first mating bump is spaced apart along the length of the first arm from the second mating surface of the second mating bump; and a second arm extending outwardly from the base along the central longitudinal axis of the base, the second arm comprising a third mating bump and a fourth mating bump for mating with the mating contact, wherein the third and fourth mating bumps of the second arm are at different axial locations along the central longitudinal axis of the base than the first and second mating bumps of the first arm.

8. The electrical contact of claim 7, wherein one or both of the first and second arms extends a width approximately perpendicular to the central longitudinal axis of the base, one or both of the first and second arms comprising a necked-down segment wherein the width of one or both of the first and second arms is reduced.

9. The electrical contact of claim 7, wherein the first and second mating surfaces are offset from the central longitudinal axis of the base by different amounts.

10. The electrical contact of claim 7, wherein one or both of the first and second arms is a spring that is configured to be resiliently deflected from a resting position when one or both of the first and second arms is mated with the mating contact, the first and second mating surfaces being offset from the central longitudinal axis of the base by different amounts when the first arm is in the resting position, the first and second mating surfaces being offset from the central longitudinal axis by approximately the same amount when the first arm is mated with the mating contact.

11. The electrical contact of claim 7, wherein the second arm has a different response to vibration than the first arm.

12. The electrical contact of claim 7, wherein one or both of the first and second arms is a spring that is configured to be resiliently deflected from a resting position when one or both of the first and second arms is mated with the mating contact.

13. The electrical contact of claim 7, wherein at least one of the first mating bump or the second mating bump is defined by a bend in the first arm.

14. The electrical contact of claim 7, wherein the mating contact is a contact pad of a circuit board, the first and second mating surfaces being configured to mate with the contact pad.

15. The electrical contact of claim 7, wherein the base comprises a mounting end, the electrical contact further comprising a mounting segment extending from the mounting end of the base, the mounting segment being configured to be mounted to a circuit board.

16. The electrical contact of claim 7, wherein one or both of the first and second arms extends outwardly from the base at a non-parallel angle relative to the central longitudinal axis of the base.

* * * * *